US008005251B2

(12) United States Patent
Chan

(10) Patent No.: US 8,005,251 B2
(45) Date of Patent: Aug. 23, 2011

(54) PORTABLE WATERPROOF EQUIPMENT

(76) Inventor: Andie Lam Chan, Hongkong (CN)

( * ) Notice: Subject to any disclaimer, the term of this patent is extended or adjusted under 35 U.S.C. 154(b) by 1385 days.

(21) Appl. No.: 11/517,542

(22) Filed: Sep. 7, 2006

(65) Prior Publication Data

US 2007/0081689 A1 Apr. 12, 2007

(30) Foreign Application Priority Data

Oct. 12, 2005 (CN) ..... 2005 2 0065814 U

(51) Int. Cl.
*H04R 25/00* (2006.01)
*H04R 1/02* (2006.01)

(52) U.S. Cl. ..... 381/374; 381/189; 381/388

(58) Field of Classification Search ..... 381/388, 381/189, 374; 383/108; 493/213
See application file for complete search history.

(56) References Cited

U.S. PATENT DOCUMENTS

| | | | | |
|---|---|---|---|---|
| 5,873,456 | A * | 2/1999 | Hull et al. | 206/38.1 |
| 6,305,844 | B1 * | 10/2001 | Bois | 383/64 |
| 2004/0056061 | A1 * | 3/2004 | Yang | 224/607 |
| 2005/0030707 | A1 * | 2/2005 | Richardson et al. | 361/681 |

* cited by examiner

*Primary Examiner* — Davetta W Goins
*Assistant Examiner* — Matthew Eason
(74) *Attorney, Agent, or Firm* — Tim Tingkang Xia; Morris, Manning & Martin, LLP

(57) ABSTRACT

A portable waterproof equipment includes a body configured for containing articles therein, a sealing structure, a cable and a sealing device. The body has an opening configured for providing an access for the articles entering into the body. The sealing structure is configured for sealing the opening of the body. The cable passes through the body and has an inner end located within the body. A plug is provided at the inner end of the cable and configured for connecting with phone jacks of the articles. The sealing device is arranged between the cable and the body.

12 Claims, 5 Drawing Sheets

PORTABLE WATERPROOF EQUIPMENT

FIELD OF THE INVENTION

This invention relates to a waterproof equipment, and particularly to a portable waterproof equipment for containing articles with earphone wires.

BACKGROUND OF THE INVENTION

A conventional portable waterproof package generally employs a plastic zipper arranged at an opening thereof. The plastic zipper comprises an elongated slot and a rib. The rib is firmly received in the slot to thereby seal the opening of the package. Therefore, the package has water-proof capability. However, when articles with earphone wires, such as walkmans, interphones, radios, are packaged in the above conventional portable waterproof equipment, the earphone wires of the articles cannot extend out of the package. If the earphone wire extends out of the package via the opening of the package, the joggled slot and rib cannot firmly engage with each other, which affects the water-proof property of the package. Furthermore, a conventional portable waterproof equipment generally employs only one plastic zipper. Therefore, requirement of rigidity to the material of the plastic zipper is correspondingly high. However, it is difficult to control the rigidity of the material of the plastic zipper. If the material of the plastic zipper is too soft the plastic zipper is easy to be opened. If the material of the plastic zipper is too hard the plastic zipper is easy to be damaged in operation. Thus from the above, water-proof property of the conventional portable waterproof equipment is not good enough.

Accordingly, there is a need to provide an improved portable waterproof equipment which overcomes the above mentioned shortcomings.

SUMMARY OF THE INVENTION

The primary objective of this invention is to provide a portable waterproof equipment which can package articles with earphone wires.

Another objective of this invention is to provide a portable waterproof equipment with improved water-proof property.

A portable waterproof equipment in accordance with the present invention comprises a body configured for containing articles therein, a sealing structure, a cable and a sealing device. The body has an opening configured for providing an access for the articles entering into the body. The sealing structure is configured for sealing the opening of the body. The cable passes through the body and has an inner end located within the body. A plug is provided at the inner end of the cable and configured for connecting with phone jacks of the articles. The sealing device is arranged between the cable and the body.

In a preferred embodiment, the cable is an earphone extension cord, the earphone extension cord has an outer end located at the outside of the body and a receptacle is provided at the outer end for receiving a plug of an earphone.

In a preferred embodiment, the cable is an earphone wire, and the earphone wire has an outer end located at the outside of the body and an earplug is provided at the outer end.

In a preferred embodiment, the sealing device comprises a disc-shaped sealing ring attached around the cable and a double-wall structure located at a conjunction between the body and the cable. A periphery of the double-wall structure is sealed. The ring is sandwiched between two walls of the double-wall structure and substantially filled with a space formed between the two walls.

In a preferred embodiment, the sealing structure comprises two parallel straps arranged at an edge of the opening. One of the straps forms a plurality of slots, the other of the straps forms a plurality of ribs configured for being received in the slots respectively. The width of each slot is slightly smaller than the thickness of the corresponding rib so that the rib can be firmly received in the slot.

In a preferred embodiment, the package further comprises a cover provided at the outer side of one of the straps, two mated parts of a hooks and loops fastener are respectively provided at the inner side of the cover and the outer side of the straps and engage to each other when the straps roll downward after the ribs are received in the slots.

The package in accordance with the preferred embodiments has the following advantages. The cable passes through the body and a sealing device is provided at the conjunction between the body and the cable. Therefore, an earphone may connect with articles packaged within the body directly or indirectly without affecting the water-proof property of the package. Furthermore, the sealing structure configured for sealing the opening of the body employs a plurality of pairs of slots and ribs which cooperatively function as a plurality of plastic zippers. The plurality of plastic zippers improves the water-proof property of the package and reduce requirement of proper rigidity to the material of the plastic zippers. Moreover, two mated parts of the hooks & loops fastener are respectively provided at the inner side of the cover and the outer side of the other of the straps and engage to each other when the straps roll downward after the ribs are received in the slots, which improve the water-proof property of the package.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
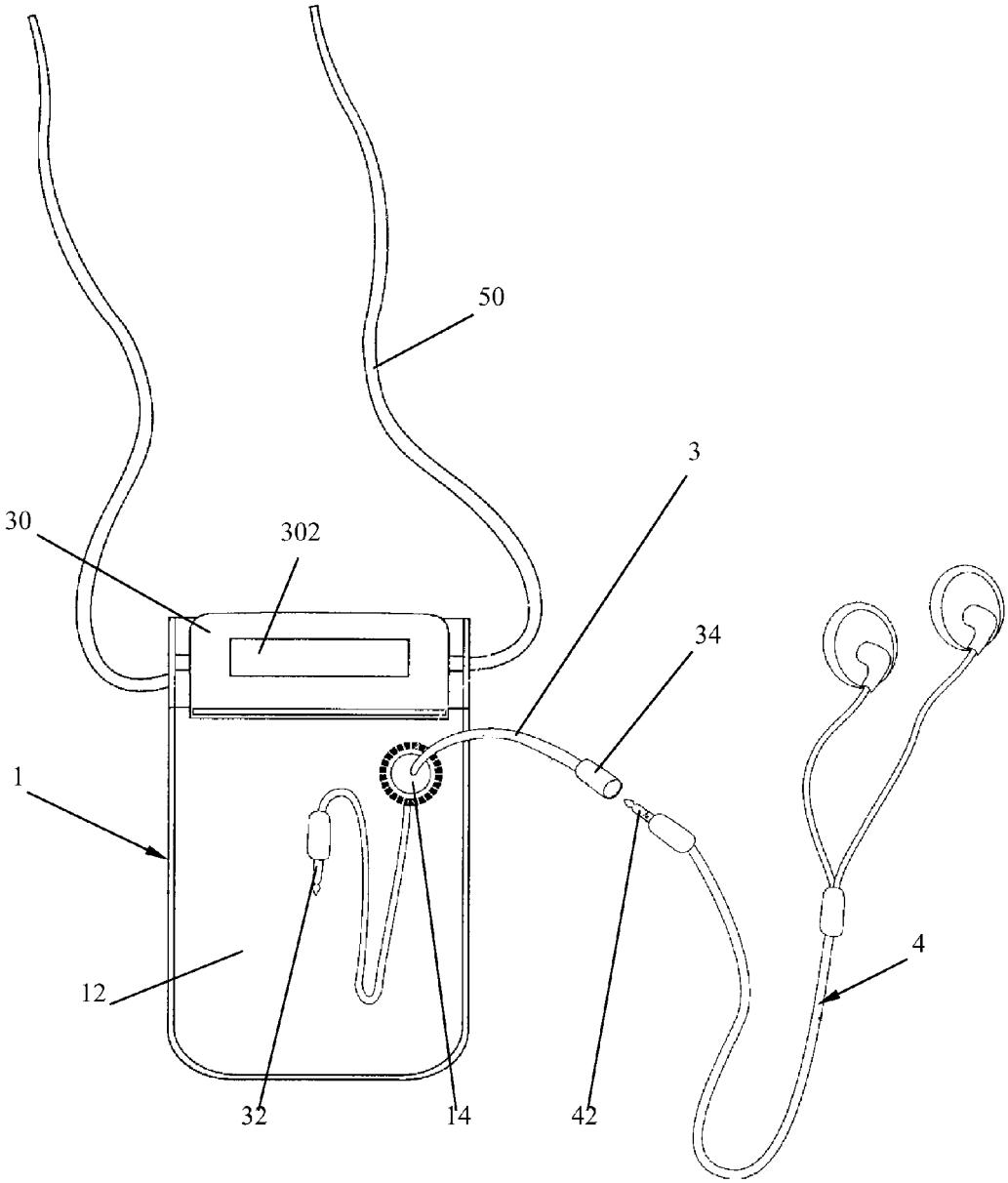
FIG. 1 is a schematic view of a portable waterproof equipment in accordance with a preferred embodiment of the present invention.
Figure 2:
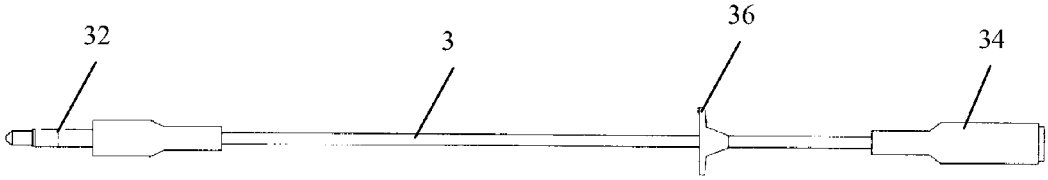
FIG. 2 is a schematic view of an earphone extension cord of the portable waterproof equipment of FIG. 1.

As shown in FIGS. 1-2, a portable waterproof equipment in accordance with a preferred embodiment of the invention comprises a hollow body 1 for containing articles (not shown) therein and a sealing structure for sealing an opening of the body 1. In the preferred embodiment, the articles may be walkmans, interphones, radios and so on. The body 1 is made of transparent material. A cable is arranged in a wall 12 of the body 1. In the preferred embodiment, the cable is an earphone extension cord 3. The earphone extension cord 3 comprises an inner end and an outer end respectively located at inside and outside of the body 1. A plug 32 is provided at the inner end of the earphone extension cord 3 and configured for connecting with a phone jack of the article packaged in the body 1. A receptacle 34 is provided at the outer end of the earphone extension cord 3 and configured for receiving a plug 42 of the earphone 4.

A sealing device is provided at the conjunction of the earphone extension cord 3 and the wall 12 of the body 1. The sealing device comprises a disc-shaped connecting member 36 attached around the earphone extension cord 3 and a double-wall structure 14 arranged at the wall 12 of the body 1. In the preferred embodiment, the connecting member 36 is a sealing ring 36. The double-wall structure 14 is located at the conjunction of the earphone extension cord 3 and the wall 12 of the body 1 and the periphery thereof is sealed. The sealing ring 36 is firmly sandwiched between two walls of the double-wall structure 14 and substantially filled with a space formed between the two walls. Thus, water is isolated from entering into the body 1 via the conjunction of the earphone extension cord 3 and the wall of the body 1.

Figure 3:
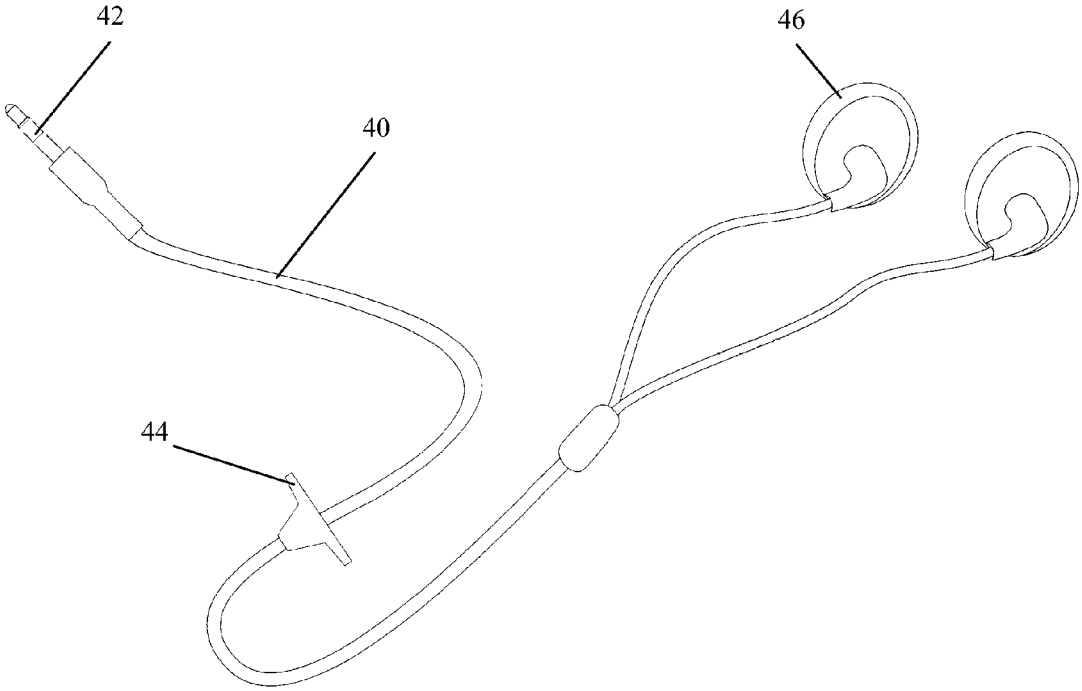
FIG. 3 is a schematic view of an earphone in accordance with another embodiment.

In the preferred embodiment described above, the earphone 4 may connect with the article packaged within the body 1 via the earphone extension cord 3. Alternatively, the earphone 4 may connect with the article directly. Referring to FIG. 3, an earphone in accordance with an alternative embodiment is provided. The earphone comprises a disc-shaped connecting member 44 attached around the earphone wire 40 thereof and configured for connecting with the double-wall structure 14 of the body 1 to thereby connect the earphone to the body 1. A plug 42 is provided at the inner end of the earphone wire 40 and configured for connecting with a phone jack of the article packaged in the body 1. A pair of earplugs 46 is provided at the outer end of the earphone wire 40, for being fitted into ears of users. The sealing device, which is similar to the sealing device described above, is provided between the wall 12 of the body 1 and the earphone wire 40.

In the present invention, the use of the earphone connection components does not affect the water-proof property of the package. Any articles with earphone connection components packaged within the package of the present invention may be used in the water. Understandably, if the earphone is waterproof it is more safety.

Figure 4:
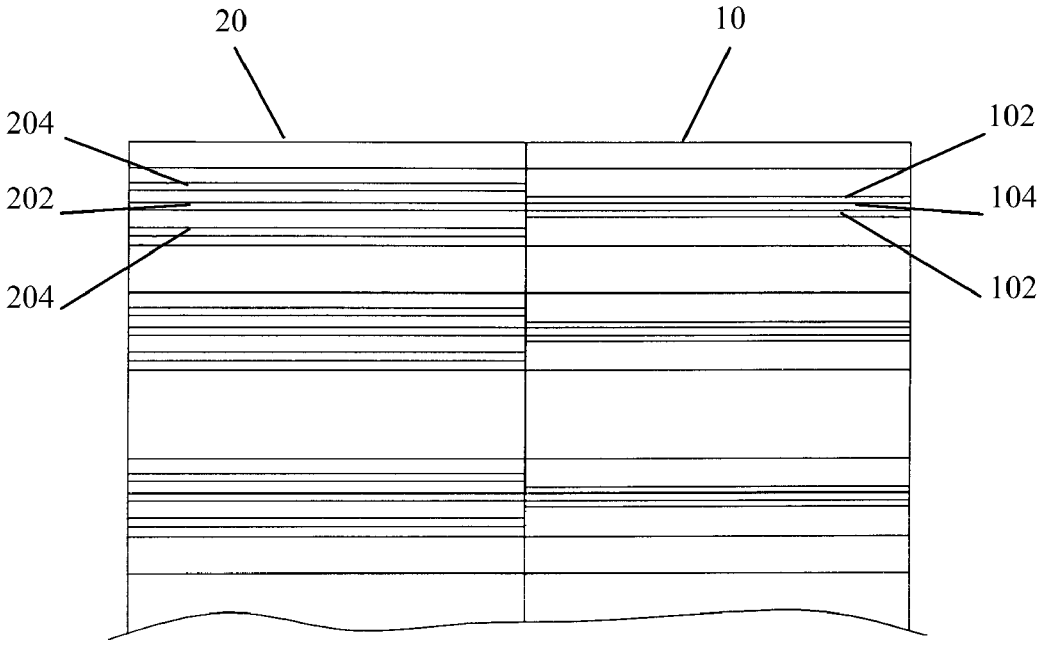
FIG. 4 is an extended plan view of a sealing structure of the portable waterproof equipment.
Figure 5:
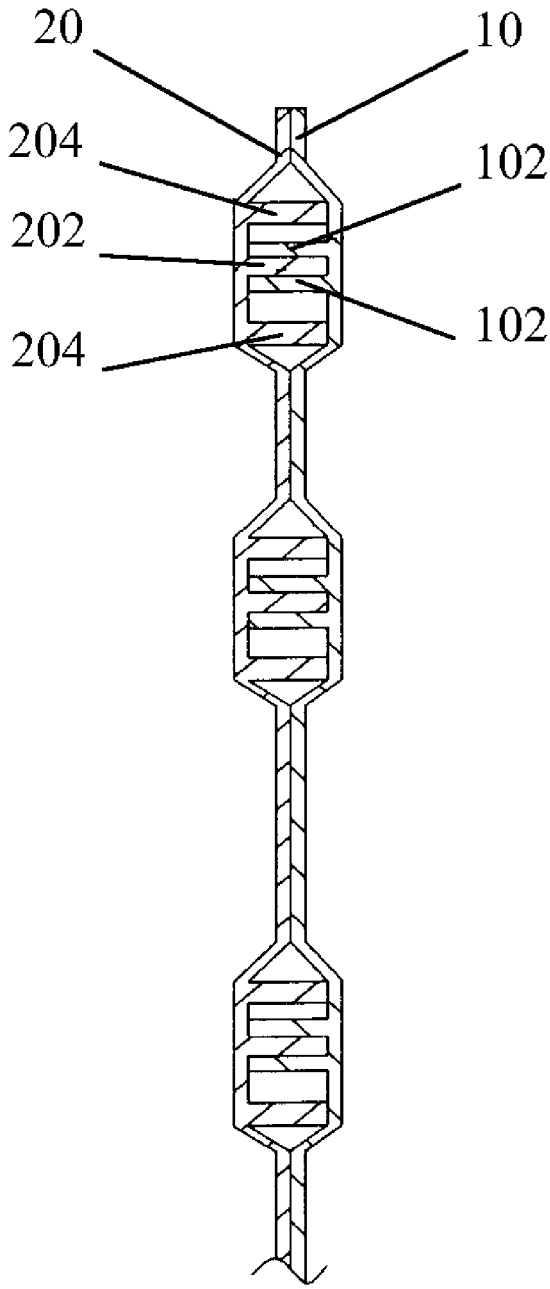
FIG. 5 is a cross-sectional view of the sealing structure when the portable waterproof equipment is close.

Referring to FIGS. 4-5, the sealing structure for sealing the opening of the body 1 is shown. The sealing structure comprises two parallel straps 10, 20 arranged along the edge of the opening of the body 1. The strap 10 comprises three pairs parallel strips 102 protruding inwardly from the inner side thereof. A slot 104 is provided between each pair of strips 102. The strap 20 comprises a plurality of ribs 202 for being received into the slots 104 of the strap 10 respectively. The width of the slot 104 is slightly smaller than the thickness of the corresponding rib 202 so that the rib 202 can be firmly received in the slot 104. A pair of parallel protruding bars 204 is formed at upper and lower sides of each rib 202. The protruding bars 204 abut against the inner side of the strap 10 when the ribs 202 are received in the slots 104. In the present invention, the number of the slots 104 is not limited to three and can be any number more than two.

When the sealing structure described above is closed, each rib 202 is sandwiched between the corresponding two strips 102 and therefore firmly received in the corresponding slot 104. The protruding bars 204 of the strap 20 abut against the inner side of the strap 10. The inner sides of the two straps 10, 20 located between each pair of protruding bars 204 contact with each other.

Referring to FIG. 1 again, for improving water-proof capability of the package, a cover 30 may be provided at the outside of the strap 20. One part 302 of a hooks & loops fastener (Velcro tape) is arranged at inner side of the cover 30. The other mated part (not shown) of the hooks & loops fastener is provided at the outside of the strap 10. When the sealing structure is closed and the ribs 202 are received in the slots 104, the straps 10, 20 are rolled downwardly to cause the two mated parts of the hooks & loops fastener of the cover 30 and the strap 10 to engage with each other. Alternatively, the hooks & loops fastener may be replaced with other structures, such as: a pair of joggled snap buttons provided at the cover 30 and the body 1 10 respectively.

Alternatively, under the condition that the strap 10 has an enough thickness, the slots 104 may be directly defined in the strap 10 without forming the strips 102. In addition, the body 1 can be any structure which can contain articles and has an opening for providing an access for the articles entering into the body 1.

In the present invention, the sealing structure employs a plurality of joggled ribs and slots which can substantially isolate the inner side of the body 1 from the outer side of the body 1. It is also difficult for air to pass through the sealing structure.

Referring to FIG. 1, a thin connecting piece (not shown) can be provided at the strap 20. The connecting piece comprises upper and lower edges secured at the strap 20 respectively. A passage is therefore formed between the upper and lower edges. A rope 50 passes through the passage and can be hang to a neck of the user, whereby facilitating taking of the package.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. A portable waterproof equipment comprising:

a body configured for containing articles therein, the body having an opening configured for providing an access for the articles entering into the body;

a sealing structure configured for sealing the opening of the body;

a cable passing through the body, the cable having an inner end located within the body, a plug being provided at the inner end and configured for connecting with phone jacks of the articles; and a sealing device arranged between the cable and the body, wherein the sealing device comprises a connecting member attached around the cable and a double-wall structure located at a conjunction between the body and the cable, a periphery of the double-wall structure being sealed, the connecting member being sandwiched between two walls of the double-wall structure and substantially filled with a space formed between the two walls.

2. The portable waterproof equipment as claimed in claim 1, wherein the cable is an earphone extension cord, the earphone extension cord further comprises an outer end located at the outside of the body, and a receptacle is provided at the outer end of the earphone extension cord for receiving a plug of the earphone.

3. The portable waterproof equipment as claimed in claim 1, wherein the cable is an earphone wire, the earphone wire has an outer end located at the outside of the body, and earplugs are provided at the outer end of the earphone wire.

4. The portable waterproof equipment as claimed in claim 1, wherein the connecting member is a disc-shaped sealing ring.

5. The portable waterproof equipment as claimed in claim 1, wherein the sealing structure comprises two parallel straps arranged at an edge of the opening, one of the straps comprising a plurality of slots, the other of the straps comprising a plurality of ribs configured for being received in the slots respectively.

6. The portable waterproof equipment as claimed in claim 5, wherein the width of each slot is slightly smaller than the thickness of the corresponding rib.

7. The portable waterproof equipment as claimed in claim 6, wherein said one of the straps further comprises a plurality of pairs of strips, each slot being formed between a pair of corresponding strips.

8. The portable waterproof equipment as claimed in claim 6, wherein said the other of the straps further comprises a pair of protruding bars formed at opposite sides of each rib, the bars abutting against the inner side of said one of the straps when the ribs are received in the slots.

9. The portable waterproof equipment as claimed in claim 8, wherein when the ribs are received in the slots the inner sides of the two straps located between each pair of protruding bars contact with each other.

10. The portable waterproof equipment as claimed in claim 5, further comprising a cover provided at the outer side of one of the straps, wherein two mated parts of a fastener are respectively provided at the inner side of the cover and the outer side of the other of the straps and engage to each other when the straps roll downward after the ribs are received in the slots.

11. The portable waterproof equipment as claimed in claim 10, wherein the fastener is a hooks & loops fastener.

12. The portable waterproof equipment as claimed in claim 5, wherein a connecting piece is provided at one of the straps, the connecting piece comprises upper and lower edges secured at said one of the strap respectively, a passage is formed between the upper and lower edges, and a rope passes through the passage.

* * * * *